US007238876B1

(12) United States Patent
Worrall et al.

(10) Patent No.: US 7,238,876 B1
(45) Date of Patent: Jul. 3, 2007

(54) METHOD OF AUTOMATED MUSICAL INSTRUMENT FINGER FINDING

(76) Inventors: Richard William Worrall, 12289 Ragweed St., San Diego, CA (US) 92129; Robert William Sharp, 17769 Frondoso Dr., San Diego, CA (US) 92128

( * ) Notice: Subject to any disclaimer, the term of this patent is extended or adjusted under 35 U.S.C. 154(b) by 5 days.

(21) Appl. No.: 10/766,633

(22) Filed: Jan. 27, 2004

Related U.S. Application Data

(60) Provisional application No. 60/444,413, filed on Feb. 3, 2003.

(51) Int. Cl.
*G10H 1/18* (2006.01)

(52) U.S. Cl. ..... 84/722; 84/477 R; 84/485 R

(58) Field of Classification Search ..... 84/477 R, 84/470 R, 609–615, 634–638, 485 R, 722; 434/307 R, 307 A, 308–316, 118, 365, 318, 434/350; 395/173; 360/32, 33, 49, 70, 77; 369/192; 348/61, 478, 738, 484, 571, 578, 348/595; 386/95
See application file for complete search history.

(56) References Cited

U.S. PATENT DOCUMENTS 3,153,970 A * 10/1964 Mulchi ..... 84/485 R
3,767,833 A * 10/1973 Noble et al. ..... 84/673
3,937,118 A * 2/1976 Leonard ..... 84/471 SR
4,295,406 A * 10/1981 Smith ..... 84/470 R
4,412,473 A * 11/1983 Laflamme ..... 84/485 R
4,671,159 A * 6/1987 Stark ..... 84/485 R
4,885,969 A * 12/1989 Chesters ..... 84/615
4,966,052 A * 10/1990 Shiraki et al. ..... 84/715
5,040,447 A * 8/1991 Murata et al. ..... 84/612
5,396,828 A 3/1995 Farrand
5,408,914 A * 4/1995 Breitweiser et al. ..... 84/477 R
5,533,903 A 7/1996 Kennedy
5,639,977 A * 6/1997 Hesnan ..... 8/477 R
5,690,496 A 11/1997 Kennedy
5,866,832 A * 2/1999 Solowiow ..... 84/485 R
5,907,115 A * 5/1999 Matsunaga et al. ..... 84/477 R
6,025,551 A * 2/2000 Munekawa et al. ..... 84/477 R
6,080,925 A * 6/2000 Rogers et al. ..... 84/485 R
6,107,557 A * 8/2000 Fukada ..... 84/485 R
6,162,981 A * 12/2000 Newcomer et al. ..... 84/485 R
6,201,174 B1 3/2001 Eller
6,331,668 B1 * 12/2001 Michero ..... 84/477 R
6,388,181 B2 5/2002 Moe
6,452,081 B1 * 9/2002 Ravagni et al. ..... 84/477 R
6,486,387 B1 * 11/2002 Munekawa et al. ..... 84/477 R
6,703,549 B1 * 3/2004 Nishimoto et al. ..... 84/609
6,751,439 B2 * 6/2004 Tice et al. ..... 434/350
2001/0003944 A1 * 6/2001 Okubo et al. ..... 84/637
2003/0110925 A1 * 6/2003 Sitrick et al. ..... 84/477 R

* cited by examiner

*Primary Examiner*—Lincoln Donovan
*Assistant Examiner*—Christina Russell
(74) *Attorney, Agent, or Firm*—Jean Ellis

(57) ABSTRACT

A computerized automated method for determining fingering of musical instruments from digitized scored music or tablature. The computerized automated finger finder method determines fingering such that hand movement is minimized on a specified instrument for maximum performance from analysis of the music score or tablature. The method also provides alternate fingering choices when the musician desires a different tonal stylization or finds an alternate fingering easier to play for their skill level.

23 Claims, 9 Drawing Sheets

METHOD OF AUTOMATED MUSICAL INSTRUMENT FINGER FINDING

CROSS-REFERENCE TO RELATED APPLICATIONS

This application is entitled to the benefit of Provisional Application Ser. No. 60/444,413 filed 2003 Feb. 2.

References Cited

Finger Finder Library For Guitar, copyright Feb. 4, 2002.

FEDERALLY SPONSORED RESEARCH

Not Applicable

SEQUENCE LISTING OR PROGRAM

Not Applicable

BACKGROUND OF THE INVENTION

1. Field of Invention

This invention relates to music, and in particular, to enhance the instrumentalists ability to perform musical scores.

2. Discussion of Prior Art

U.S. Pat. No. 6,201,174 to Eller (2001) discloses a computerized tablature composer that generates tablature notation from conventional staff notation. This is shown in the prior art figure, step 602. However, how to perform this step is not obvious, and Eller's patent gives no indication on how to do this. In addition, Eller's patent does not generate an automated fingering sequence in order to perform the musical composition efficiently.

U.S. Pat. No. 5,396,828 to Farrand (1995) discloses a means for automatically producing guitar fingerboard information for chords from staff notation. Farrand's invention analyzes the music for various instruments and produces guitar chords that fit the harmonic rhythm of the melody, it does not give the fingering positioning of the exact notes in the staff notation that a guitar would play, and it only deals with chords, not individual notes of the melody. For example, in U.S. Pat. No. 5,396,828 FIG. 14, the first measure of the music depicts a D chord in second position on the guitar fingerboard; this is not, however, how the three notes shown in the staff of the music would be played by the guitar (i.e., Farrand's chord does not depict the exact voicing of the chord from the staff notation).

U.S. Pat. No. 5,639,977 to Hesnan (1997) discloses a music learning aid that displays playing instructions associated with musical notes. However, Hesnan's invention does not give an automated means for determining optimal or secondary fingering of an instrument for a given musical piece.

Various patents (e.g., U.S. Pat. Nos. 5,533,903, 5,639,977, 5,690,496, and 6,388,181) discuss the depiction of musical instrument fingering. However, none of them provide a method for automatically determining the fingering information.

BACKGROUND OF THE INVENTION

From the beginning of notated music, musicians have been composing music for other musicians to learn and perform. In classical staff notation, many composers have had or have the added skill of adding the symbols required, given a particular instrument, to explain the actual fingering of the musical score to be performed on the instrument by designating the fingers on the instrument for specific notes to accomplish the performance of the musical piece. That is called symbolic fingering notation. It is extremely important to the overall musical sound that the musical staff notation for each instrument have the proper symbolic fingering notation to maximize the efficiency of playing and control of time and sound (i.e., a way of the composer and virtuoso performer tell where to put your fingers). If fingering is added to a score, it is by this manual method and not automatically generated.

Although most string instruments also use some kind of tablature to determine the string length or pitch to be expressed other than standard musical notation, tablature is inefficient for the performer to play the piece since tablature only depicts the string length and not the proper fingering required to perform a musical composition.

The "Method of Automated Musical Instrument Finger Finding" is designed to automatically analyze musical data, which includes musical score and tablature data, and notate proper fingering for a musical instrument for someone to enhance their ability to play the music.

By far, most musical scores using both standard staff notation and/or tablature will not include fingering for the musician's maximum performance. Even if one does, the musician might want one or more fingering options of the score or portions of it. This invention analyzes music data (staff notation and/or tablature) for an instrument and provides the musician with the best possible fingering by predetermining what fingering to use for the instrument from the musical data. Range of notes, for example, would be a determining factor in the fingering. Other important factors would be tone, speed of performance, and the ability to play relaxed or natural to the physical limitations of one's skill level. Consequently, this invention also generates intelligent secondary options for the selection of fingering.

This invention would not only be useful for composers, but also for teachers explaining to their students the best way to play a musical composition, by music publishers allowing them to scan musical scores and have a "performance ready" printout of the music to sell, and by the performer who could now take any music available within the range of his instrument and use this invention to come up with a professionally correct fingering for the performance. This would be a tremendous time and labor saver.

BACKGROUND OF INVENTION—OBJECTS AND ADVANTAGES

Accordingly, several objects and advantages of the present invention are:

(a) To decrease the costs and decrease the time-to-market of publishers getting music published with professional fingering information.

(b) Enhance performance and publication of music originally composed for one instrument to be easily performed on other instruments.

(c) Enhance sale of publication of music by making the music more easily playable.

(d) Music composition software would be enhanced and more attractive to customers with the addition of the finger finding feature of this invention.

(e) Enhance composers' ability to compose by giving them knowledge on the ease of playability of their composition on an instrument.

(f) To enhance the ability of the performer with secondary options of fingering on their instrument.

(g) Enhance teaching abilities by teaching students how to play instruments for which the teacher is not as skilled on.

Further objects and advantages of the present invention will become apparent from a consideration of the drawings and ensuing description.

SUMMARY

In accordance with the present invention a method of generating the optimal and secondary fingering for a given musical instrument from musical score and/or tablature data.

Figure 1:
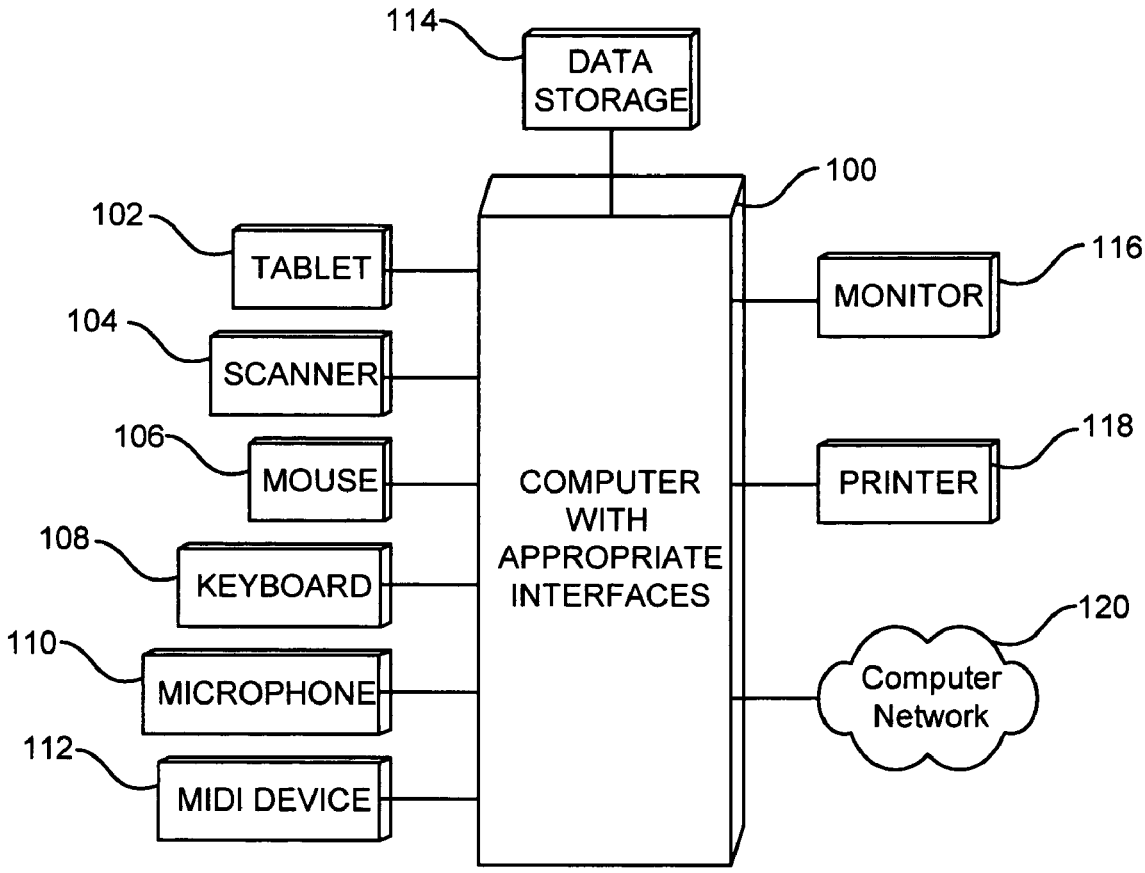
FIG. 1 illustrates an exemplary computing system for use in conjunction with an embodiment of the Finger Finder invention.

| DRAWINGS--Reference Numerals | |
|---|---|
| 100 | Computing System |
| 102 | Drawing Tablet Input |
| 104 | Scanning Input System |
| 106 | Mouse Input |
| 108 | Keyboard Input |
| 110 | Microphone Input |
| 112 | MIDI Input/Output Device |
| 114 | Secondary Storage Input/Output Device |
| 116 | Display Monitor Output |
| 118 | Printer Output |
| 120 | Computer Network |
| 200 | Instrument Position Axis |
| 202 | Time Axis |
| 204 | Stroke |
| 206 | Positional Range Group |
| 208 | Positional Range Group |
| 210 | Positional Range Group |
| 212 | Positional Range Group |
| 214 | Positional Range Group |
| 216 | Transition from group 206 to group 212 |
| 218 | Transition from group 212 to group 214 |
| 220 | Positional Range Group |
| 222 | Transition from group 214 to group 228 |
| 224 | Transition from group 230 to group 226 |
| 226 | Positional Range Group |
| 228 | Positional Range Group |
| 230 | Positional Range Group |
| 232 | Transition from group 228 to group 230 |
| 234 | Transition from group 228 to group 226 |
| 236 | Transition from group 226 to group 244 |
| 238 | Transition from group 230 to group 242 |
| 240 | Transition from group 244 to group 250 |
| 242 | Positional Range Group |
| 244 | Positional Range Group |
| 246 | Positional Range Group |
| 248 | Transition from group 244 to group 246 |
| 250 | Positional Range Group |

-continued

| DRAWINGS--Reference Numerals | |
|---|---|
| 252 | Transition from group 242 to group 250 |
| 300 | Finger Finder Routine Entry Point |
| 302 | Initialization Activities Of Positional Range Stroke Group Creation and Assignment Of Strokes To Group |
| 304 | Decision Point: Determining If Finished Creating Groups And Assigning Strokes To Groups |
| 306 | Getting Positional Range Of A Stroke |
| 308 | Initialization Activities For Transversal Of Positional Ranges Of Stroke |
| 310 | Decision Point: Determining If On Last Positional Range Of Stroke |
| 312 | Activity To Access Next Stroke |
| 314 | Decision Point: Determining If Group Already Exists For Stroke's Positional Range |
| 316 | Adding Stroke To Existing Group |
| 318 | Creating New Positional Range Stroke Group For Stroke |
| 320 | Termination Activity Of Creating New Group |
| 322 | Decision Point: Determining If There Is Only One Group Stroke Is In |
| 324 | Denoting Stroke As One That Is Only In One Group |
| 326 | Activity To Access Next Positional Range Of Stroke |
| 328 | Initialization Activities For Determining Which Positional Range Groups Are Used |
| 330 | Decision Point: Determining If Finished Determining Which Positional Range Groups Are Used |
| 332 | Decision Point: Determining If Stroke Can Only Be Played In One Group |
| 334 | Decision Point: Determining If On Last Stroke |
| 336 | Decision Point: Determining If There Was A Previous Stroke That Could Only Be Played In One Group |
| 338 | Activity To Find Used Group(s) If On Last Stroke And Last Stroke Is In Multiple Groups |
| 340 | Activity To Find Used Group(s) Upon Finding First Stroke That Could Only Be Played In One Group |
| 342 | Activity To Find Used Group(s) Upon Finding Subsequent Stroke That Could Only Be Played In One Group |
| 344 | Activity After Finding Used Group(s) |
| 346 | Activity To Access Next Stroke |
| 348 | Initialization Activity For Determining Actual Fingering |
| 350 | Decision Point: Determining If Done |
| 352 | Finding Group Stroke Is In |
| 354 | Finding Key Boundary Stroke |
| 356 | Determining Hand Position On Instrument For Group |
| 358 | Determining Fingering Positions For Strokes In Group |
| 360 | Marking Group As Unused Once It Is Finished |
| 362 | Activity To Access Next Used Group |
| 364 | Finger Finder Exit Point |
| 400 | Composition Container |
| 402 | Composition Line Container |
| 404 | Measure Container |
| 406 | Stroke Container |
| 408 | Note Container |
| 410 | Chord Container |
| 500 | Half Note Playing At Same Time As Four Eighth Notes |
| 502 | Quarter Note Playing At Same Time As Two Eighth Notes |
| 504 | Six Eighth Notes In Succession |
| 506 | Eighth Note Duration Chord |
| 508 | Eighth Note Duration Chord |
| 510 | Eighth Note Duration Chord |
| 512 | Eighth Note Duration Chord |
| 514 | Eighth Note Duration Chord |
| 516 | Eighth Note Duration Chord |
| 518 | Half Note |
| 520 | Quarter Rest Note Giving Half Note Solo Duration |
| 522 | Quarter Note |
| 524 | Quarter Note |
| 526 | Quarter Note Duration Chord |
| 600 | Graphical Output Of Example Program Using Finger Finder Routine For Guitar |
| 602 | Window Containing Composition |
| 604 | Selected Stroke |
| 606 | Window Containing Fingering Of Selected Stroke |
| 608 | Row Of Fret Numbers |
| 610 | Column Of String Numbers |
| 612 | Finger Number In Circle |

DETAILED DESCRIPTION OF THE INVENTION

FIG. 1 shows an exemplary computing system for use in conjunction with an embodiment of the Finger Finder invention. Here, the Finger Finder invention is executing on 100, with its input (a musical composition for an instrument) coming from some kind of input device, like:

- A tablet 102 where a user would enter a composition onto the tablet with a pen type of device.
- A scanner 104 that a user would use to scan in sheet music.
- A mouse 106 likely used in combination with a keyboard 108 that a user would use to enter a composition.
- A microphone 110 that a user would play a musical instrument into to digitize and automatically notate the played composition.
- A MIDI device 112, like a common kind of electronic keyboard, a user could connect directly to their computer and play and automatically notate the played composition.
- A data storage device 114 where a previously stored composition could reside.
- A computer network (a LAN or a WAN, like the Internet) 120 where the composition could come from a remote machine.

The output of the Finger Finder invention could be:

- Sent to a MIDI device 112 that can make use of the data.
- Placed on a data storage device 114 for later retrieval or electronic publishing purposes.
- Shown on a monitor 116 for viewing in a teaching or composition creation environment.
- Printed to a plotter or printer 118 for paper publishing purposes.
- Sent across a computer network 120 for remote analysis, paper or electronic publishing, or data storage or sharing purposes.

Figure 2:
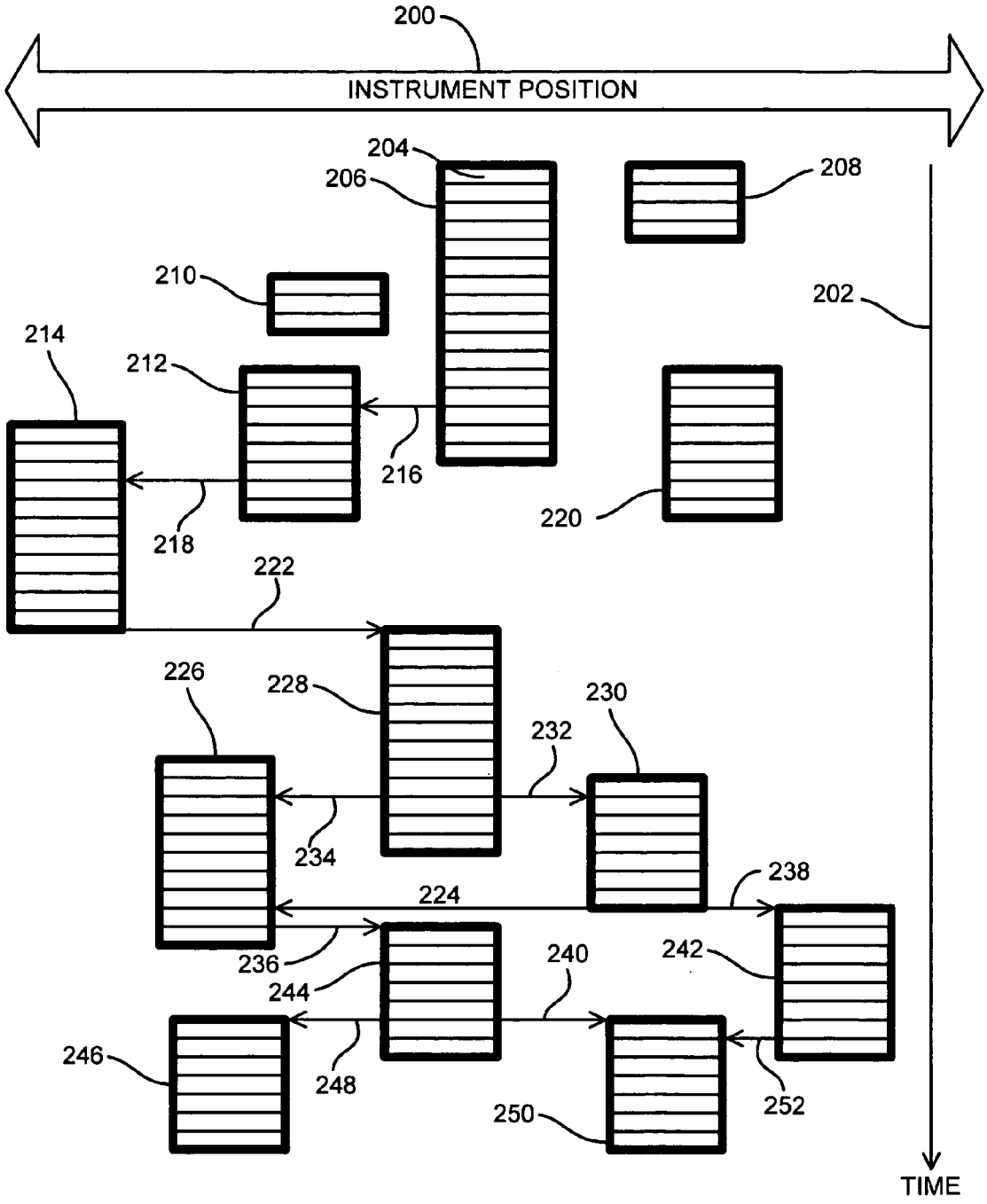
FIG. 2 illustrates the operational characteristics of the Finger Finder.

This invention automates the determination of instrument finger finding by the method of gathering and analyzing stroke groups. FIG. 2 illustrates this. This figure is a plot of physical instrument position 200 in the horizontal dimension versus time 202 in the vertical dimension (time increasing going down). Thin individual boxes, like box 204, represent the strokes, and a group of strokes are surrounded by a thicker box, like box 206. The horizontal dimension of the group boxes represents positional range that the group of strokes can be played at; that is, the hand on the instrument can play all the strokes in the group in one place.

For the example shown in FIG. 2, the first several strokes can be played either at the positional ranges within group 206 or group 208. Afterwards, the next couple of strokes can only be played within group 206. For fingering determination based on efficient hand movement, group 208 would be discarded in favor of playing the first several strokes all within group 206 as no hand movement is required. However, an embodiment of this program may give the user an option to prefer playing all or some of the strokes in group 208 based on easier fingering of the instrument or preferable tonal qualities of the instrument at this position over the position of group 206. This preference may be based on manual input by the user, or based on a setting within the program giving preference to one or more locations.

Likewise, there are some strokes afterwards that can be played either in group 206 or in group 210, followed by strokes only being able to be played in group 206. Again, for efficient hand movement, group 206 would be preferred, unless overridden by a user preference for other locations based on other criteria.

At a time later, there are a set of strokes that can either be played within group 206, 212, or 220, followed by a set of strokes that can be played within group 206, 212, 220, or 214, followed by a set of strokes that only be played within group 214. Unless overridden by user preferences to the contrary, the finger finder would choose the strokes to be played within group 206, transitioning to group 212 (via transition 216) at a musical key boundary, and then transitioning to group 214 (via transition 218) at a musical key boundary. (A musical key boundary would be marked, for example, as a C note in the key of C.) In this manner, there are two transitions from group 206 to group 214, each transition giving the minimal hand movement across the instrument. Another user preference, however, may be to minimize the number of hand transitions, and so all the strokes would be played within group 206 followed by a direct transition to group 214 where the strokes within that group would be played until a transition to another group would be required.

The determination of going from group 206 to group 212 to group 214 was based on the fact that there were strokes that could only be played in group 214, that group 206 had to be started at since starting at group 208 would have required an undesirable hand transition to group 206, that going to group 210 was undesirable as another transition back to group 206 would have been needed, and that going to group 212 was desirable as that provided an intermediate minimal hand transition.

A second set of circumstances is shown following the strokes played within group 214 and transitioning to group 228 via transition 222. At this point, there are multiple places to play the rest of the strokes. In this case, group determination is done by determining the minimal total path distance; that is, the total hand movement not just from one group to another, but taking into account all of the combinations of group traversal until the last stroke.

For example, from group 228, either group 226 or 230 would have to be transitioned to as there is a set of strokes that can only be played in group 226 or 230. From group 226 a transition to group 244 is required, and from group 230 a transition to group 242 or 226 would be required. From group 244 a transition to group 246 or group 250 would be required, and from group 242 a transition to group 250 would be required. The actual group transition sequence, without user preference overrides, would be determined by the minimum of the following transitions:

(i) Transition 234+transition 236+transition 248

(ii) Transition 234+transition 236+transition 240

(iii) Transition 232.+transition 238+transition 252

(iv) Transition 232+transition 224+transition 236+transition 248

(v) Transition 232+transition 224+transition 236+transition 240

In case of multiple paths having the same minimal total distance, the Finger Finder would prefer the path with the most right or left, or top or bottom, as appropriate for the instrument under consideration, number of groups.

Figure 3A:
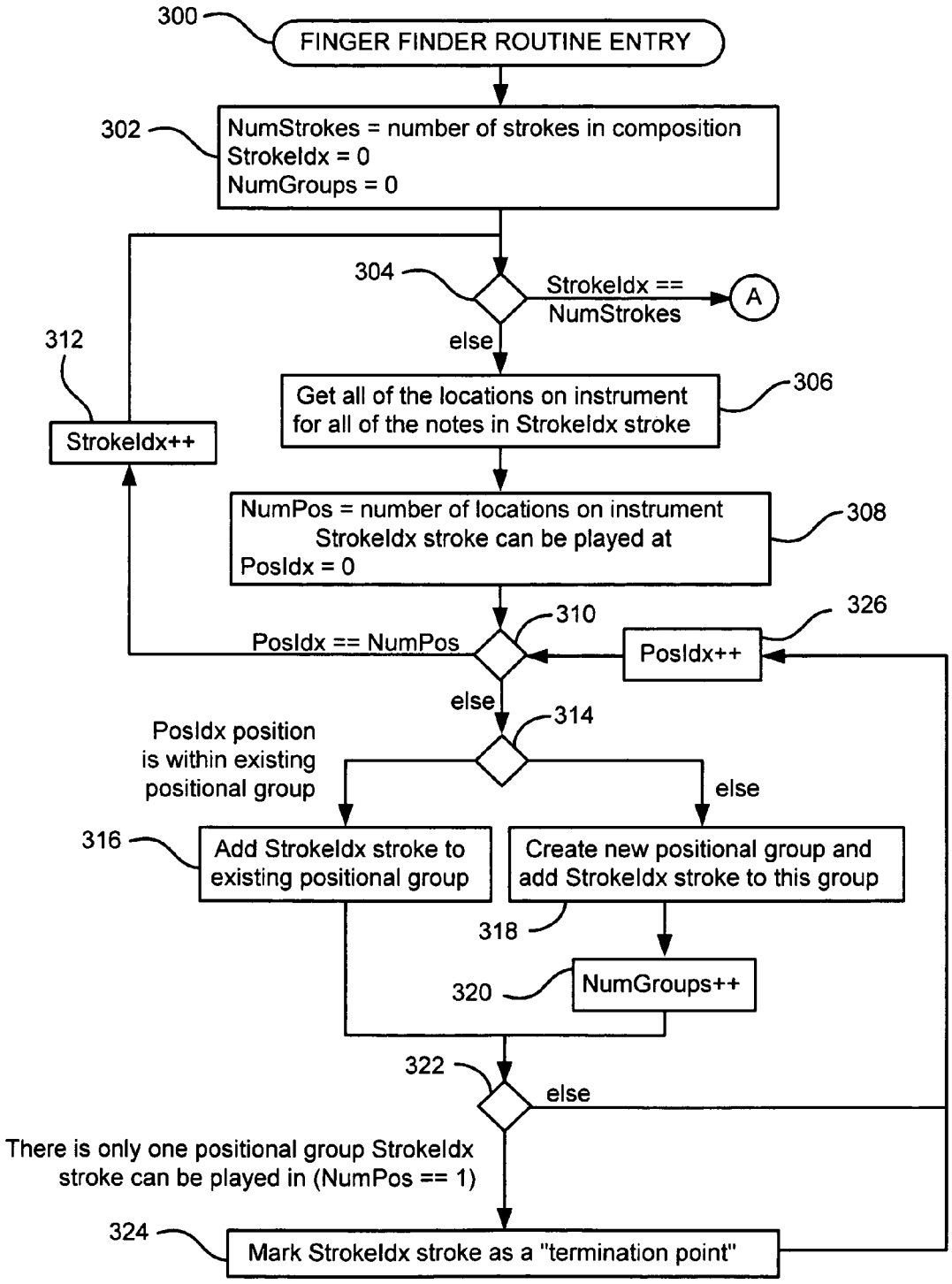
FIG. 3 is a flowchart giving the activities performed by the Finger Finder invention.
Figure 3B:
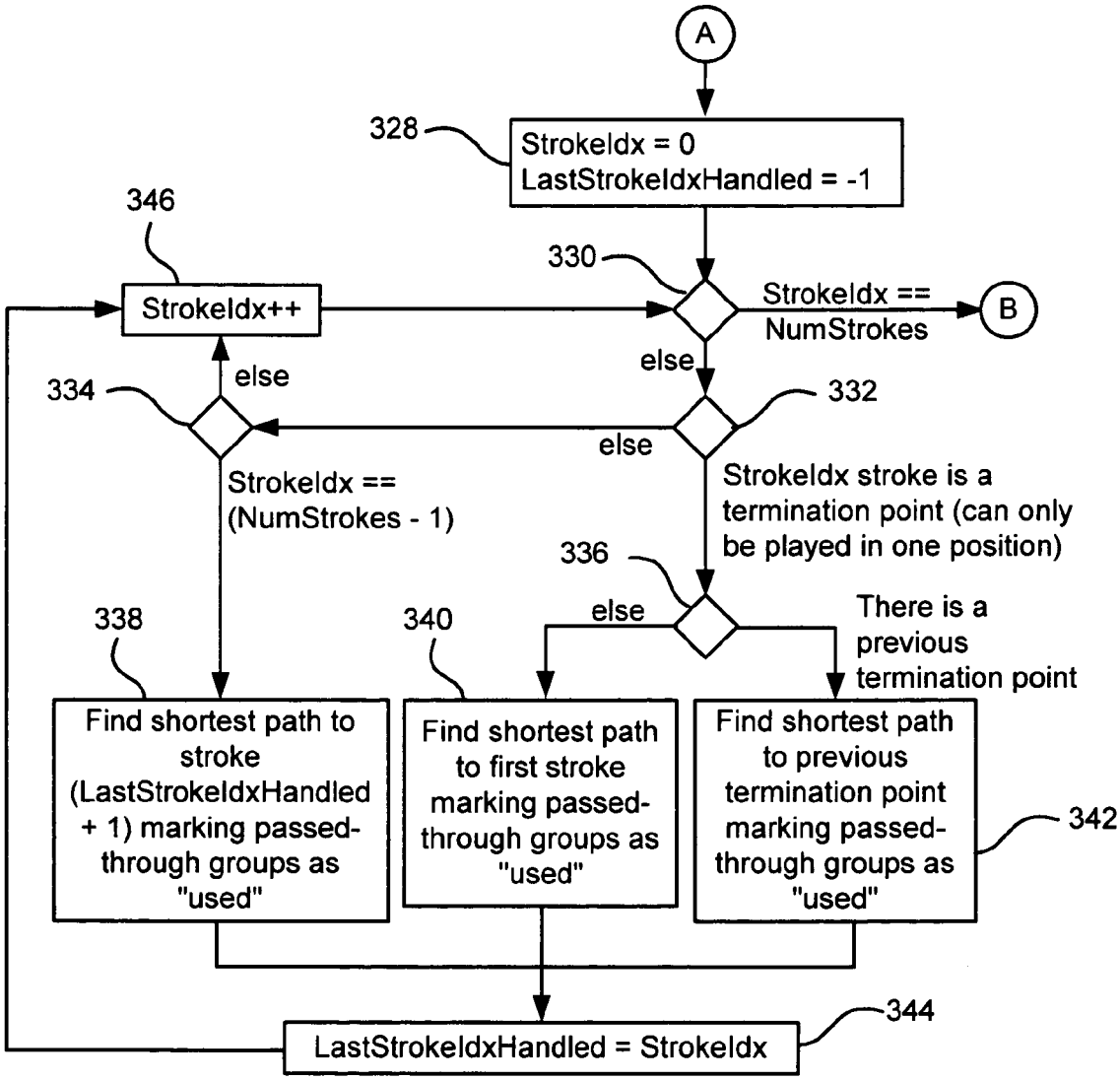
Figure 3C:
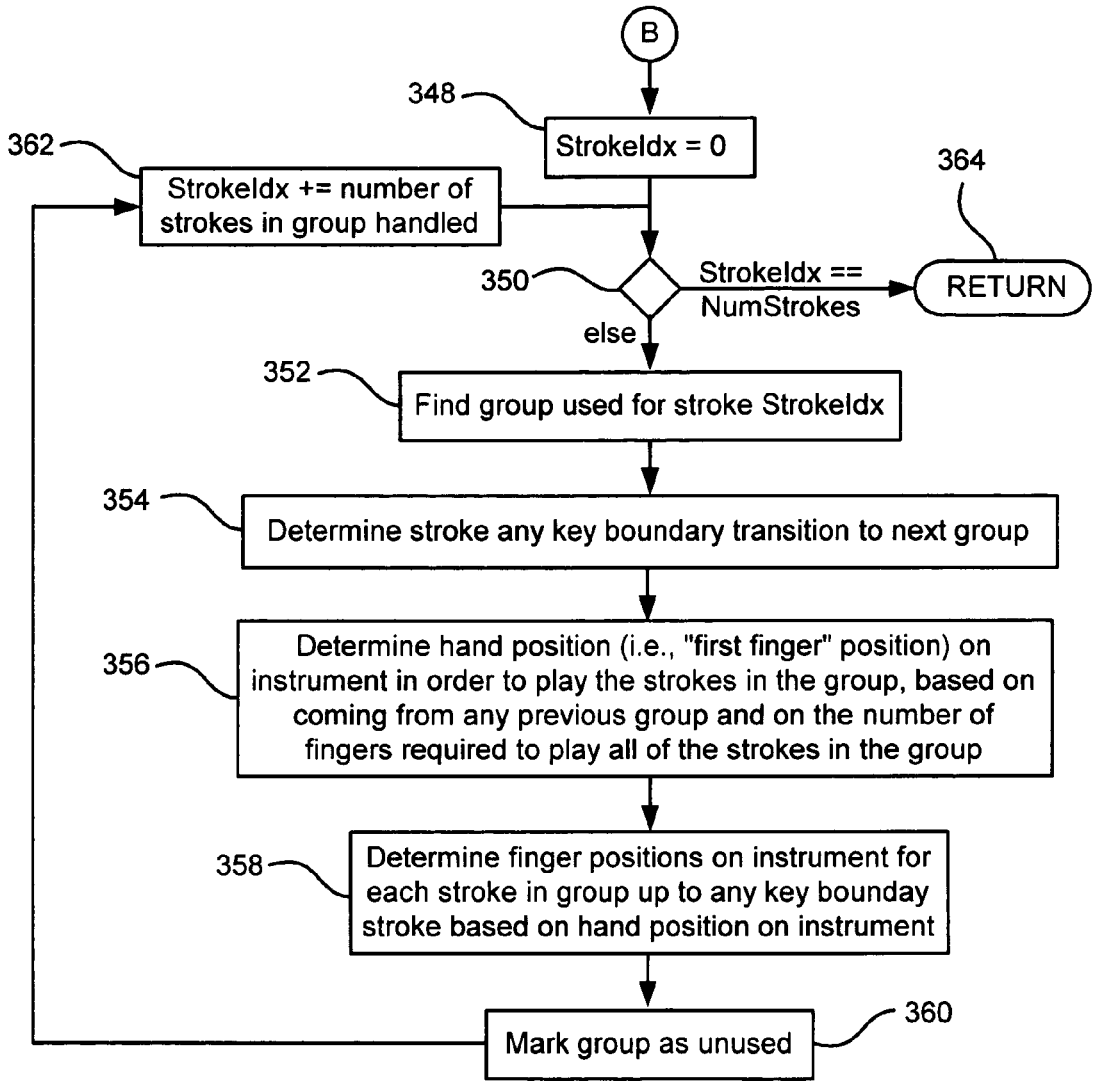

FIG. 3 is a flowchart illustrating the activities performed by the Finger Finder invention, according to an exemplary embodiment of the invention. FIG. 3A shows the activities required for determining all of the groups and the strokes associated with the groups. FIG. 3B shows the activities required for determining which groups are to be used for Finger Finding purposes. FIG. 3C shows the activities required for determining the actual fingering positions on the instrument.

Figure 4:
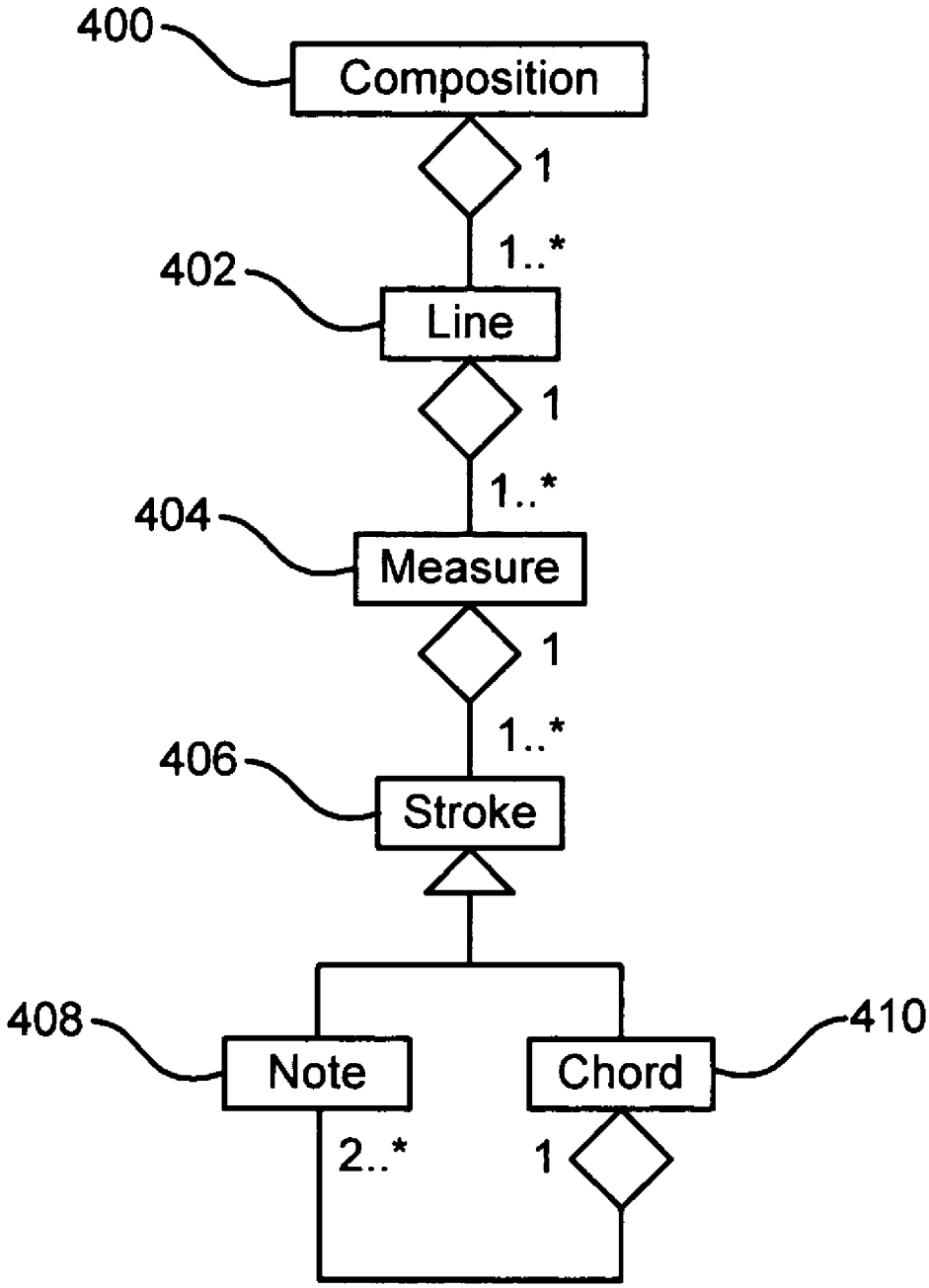
FIG. 4 illustrates an exemplary composition input for an exemplary embodiment of the Finger Finder invention.

Step 300 is the entry in to the Finger Finder invention. The data input to the Finger Finder is the composition data of a musical instrument, as illustrated by FIG. 4.

Step 302 is the initialization activities of the Finger Finder. Activity variables are shown in this block that are used to qualify other activities later on. Activity variable NumStrokes represents the total number of strokes in the composition; this number is the actual number of fingering positions, where any repeated sequences in the composition are taken into account and duplicated and placed in the input stream. Activity variable StrokeIdx represents an index into the strokes, where index value 0 accesses the first stroke of the composition, and an index value of (NumStrokes −1) accesses the last stroke of the composition. Activity variable NumGroups represents the total number of positional range stroke groups that this flowchart creates.

Item 304 is a decision point. If all of the strokes in a composition have been handled (by creating positional range groups and assigning the strokes to these groups), then the Finger Finder next determines which groups are to be used for Finger Finding purposes, starting with activity 328.

Activity 306 is the retrieving of all of the positional ranges on the instrument that the stroke under consideration can be played at. Activity 308 is the initialization activities required to access the different positional ranges of the stroke.

Activity 310 is a decision point. If all of the positional ranges of the current stroke have been handled, then activity 312 is branched to; otherwise, activity 314 is branched to.

Activity 312 is the activity required to access the next stroke.

Activity 314 is a decision point. If a positional range stroke group already exists at the current time (meaning that the previous stroke and the current stroke share a common group), then activity 316 is performed; otherwise, activity 318 is performed.

Activity 316 associates the current stroke to an existing positional range stroke group. Activity 318 creates a new positional range stroke group and associates the current stroke to this new group. Activity 320 increments by one the count of the total number of groups, to be used later.

Activity 322 is a decision point. If there is only one positional range group that the current stroke can be played in, then activity 324 is performed, in which the stroke is marked as a "termination point" (i.e., a stroke that can only be played in one group). After activity 324 or if the stroke can be played within multiple groups upon arriving at activity 322, activity 326 is performed, which is done in order to access the current stroke's next positional range group.

Activity 328 is the initialization activities required to determine which groups are used for the purposes of finger finding. As before, StrokeIdx is the variable used to access the strokes in the composition. Activity variable LastStrokeIdxHandled represents the index into the strokes that was last handled by the activities of FIG. 3B.

Activity 330 is a decision point, where if all of the groups have been found, then the flowchart starts the activities of determining the actual fingering, starting with activity 348. If all the groups have not yet been handled, then activity 332 is gone to.

If a stroke under consideration can only be played within one positional range group (the stroke is a "termination point"), activity 332 branches to activity 336, and if there was a previous termination point, then activity 336 branches activity 342 where the shortest path to the previous termination point is found, as described for FIG. 2, where the groups that are used are marked as such for later. If there was no previous termination point, then activity 336 branches to activity 340 where the shortest path to the first stroke in the composition is found, as described for FIG. 2, where the groups that are used are marked as such for later.

If the current stroke is not a termination point, then activity 332 branches to activity 334, where if the current stroke is the last stroke in the composition, then activity 334 branches to activity 338 where the shortest path to the previously handled last stroke is found (which may be the first stroke of the composition if there are no termination points), as described for FIG. 2, where the groups that are used are marked as such for later.

After activity 338, 340, or 342 is performed, activity variable LastStrokeIdxHandled is set to the current stroke index in order to find the shortest path from a later stroke to this stroke (if this is not already the last stroke).

If the current stroke is not the last stroke of the composition in activity 334 or after activity 344 is performed, activity 346 is performed, which is the activity required to access the next stroke in the composition.

Activity 348 is the initialization activity required to find the actual fingering of the instrument for the strokes in the composition, which then branches to activity 350. If all the strokes have been handled, then activity 350 exits the Finger Finder via 364; otherwise, activity 352 is entered.

Activity 352 finds the group used for the stroke under consideration then goes to activity 354 which goes through the group to find and stroke at or crossing a key boundary to the next used group. Activity 354 leads to activity 356 which determines the hand position on the instrument; this is based on the previous group that is being come from, if any, and the number of fingers needed to play the strokes in the group. For example, if not all the fingers on the hand are needed to play the strokes, then the hand may be able to transition to the position in such a way as to minimize the transition distance (and therefore transition time), so that a stroke that would normally be played by one finger will actually be played by another.

Activity 356 leads to activity 358, where, based on the hand position on the instrument, the fingering positions on the instrument is determined for the strokes in the group up to but not including the key boundary stroke. After this, the group is listed as unused in activity 360 so the group that the next stroke is in can be found. Afterward, activity 362 is performed, which is required in order to access the first stroke in the next group.

FIG. 4 is a diagram illustrating an exemplary composition input for an exemplary embodiment of the Finger Finder invention, as would be fed as the input to the Finger Finder of FIG. 3 item 300. This figure shows how a composition for a musical instrument can be implemented as a composition container (e.g., a C data structure or a C++ or Java class) 400 being composed of a 1 or more composition line containers 402, which are themselves composed of one or more measure containers 404, which are themselves composed of one or more stroke containers 406. This figure also shows that a note container 408 and a chord container 410 are subtypes of the stroke container 406, and that a chord container 410 is composed of two or more note containers 408.

Different variations of this could be implemented as input to the Finger Finder. The above scheme works fine if the key of the composition is maintained with the line object 402, where different lines could be in different keys. The key could alternately be maintained in the measure container 404, which could then remove the need for a line container 402.

The measure container 404 is handy for containing information about such measure related information as the beginning measure and the end measure of a repeated sequence, so that the Finger Finder can find strokes that aren't necessarily next to each other as written on sheet music. Alternately, the software that creates the input for the Finger Finder could create a data structure such that all the notes are linearly accessed by the Finger Finder (so, e.g., the strokes in a repeated sequence are duplicated and put in the data structure where appropriate) and have the key that the composition is currently in maintained with the stroke container, so that the measure container 404 and the composition line container 402 would not be needed; this is the configuration assumed by FIG. 3, but the other arrangements are considered by this invention as well, it is only the means of accessing the strokes, not handling them once accessed that is the main point of this invention.

Figure 5A:
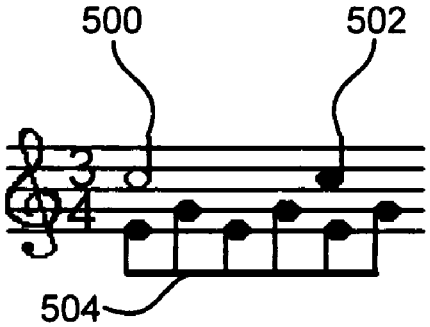
FIG. 5 illustrates one of the options for the exemplary composition input for an exemplary embodiment of the Finger Finder invention.
Figure 5B:
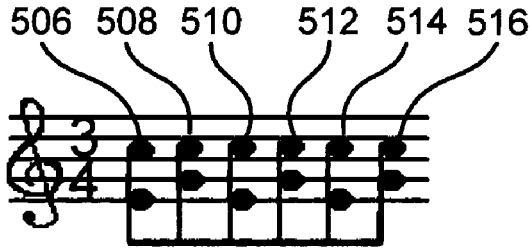

Another option for the input involves the stroke container 406 when there occurs, at the same time, multiple strokes of different durations, as shown in FIG. 5A. In FIG. 5A, stroke 500, a half note, is struck and held until four of the eighth notes of 504 are played, and then stroke 502, a quarter note, is struck and held while the remaining two eighth notes of 504 are played. Since the timing of the composition is not a factor in determining the fingering of an instrument for this invention, the program creating the input for the Finger Finder may internally represent the composition of FIG. 5A as shown in FIG. 5B. In FIG. 5B, half note 500 is broken into four eighth notes, 506, 508, 510, and 512, and combined with four of the eighth notes of 504, thus creating four eighth note chords; for this representation, the internal data content for notes 508, 510, and 512 would have to include information that these notes are not to be played (struck) again, but they exist only for finding the correct fingering of the instrument. Likewise, quarter note 502 is broken into two eighth notes, 514 and 516, and combined with the last two eighth notes of 504, thus creating two eighth note chords; again, the internal data content for note 516 would have to include information that this note is not to be played (struck) again, but it exists only for finding the correct fingering of the instrument.

Figure 5C:
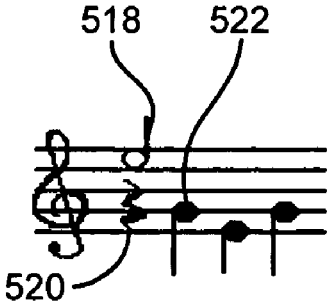
Figure 5D:
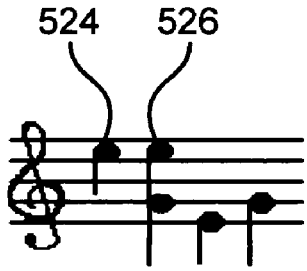

FIG. 5C shows a very similar construction as FIG. 5A. In FIG. 5C, a half note 518 is paired with a quarter rest 520, meaning that stroke 518 is played for a quarter time, then continued to be held for the duration of the next quarter note 522. As in the preceding paragraph, for finger finding purposes this could be refactored as shown in FIG. 5D, where half note 518 is broken into two quarter notes 524 and 526. Notice that note 526 is now combined with note 522 to make a chord. As above, the internal data representation of note 526 would have to indicate that it is not actually played, it is there only for finding the correct fingering of the instrument.

The output of the Finger Finder contains information on the fingering for the instrument; e.g., the number of hand positions in the output data, followed by an array of hand positions containing information such as an indication of which hand is being described (differentiating between the right hand and the left hand, as appropriate), and information denoting which finger is where on the instrument. For example, for a guitar this information would indicate which finger of the left hand is on which string and at which fret; for a piano this information would indicate which hand and which finger is pressing which key. For an implementation of this invention, an indication of which stroke in the composition the fingering data refers to may also be desired for graphical user interface purposes.

Figure 6:
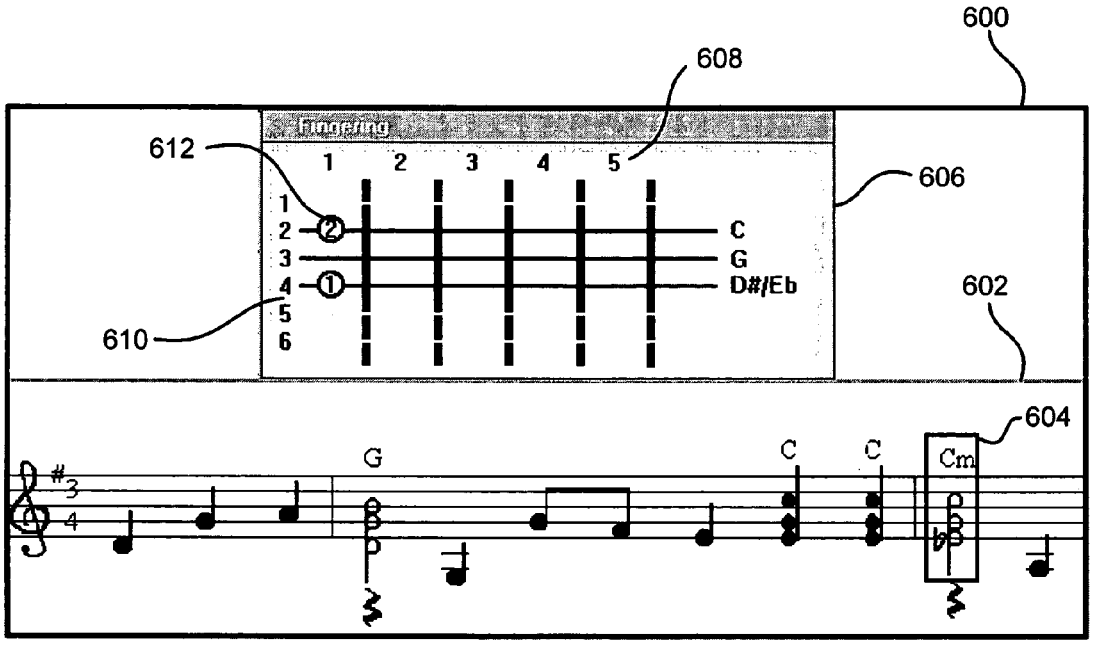
FIG. 6 illustrates an exemplary embodiment of the Finger Finder invention where the complete fingering of a guitar composition is shown by the embodiment.
Figure 6A:
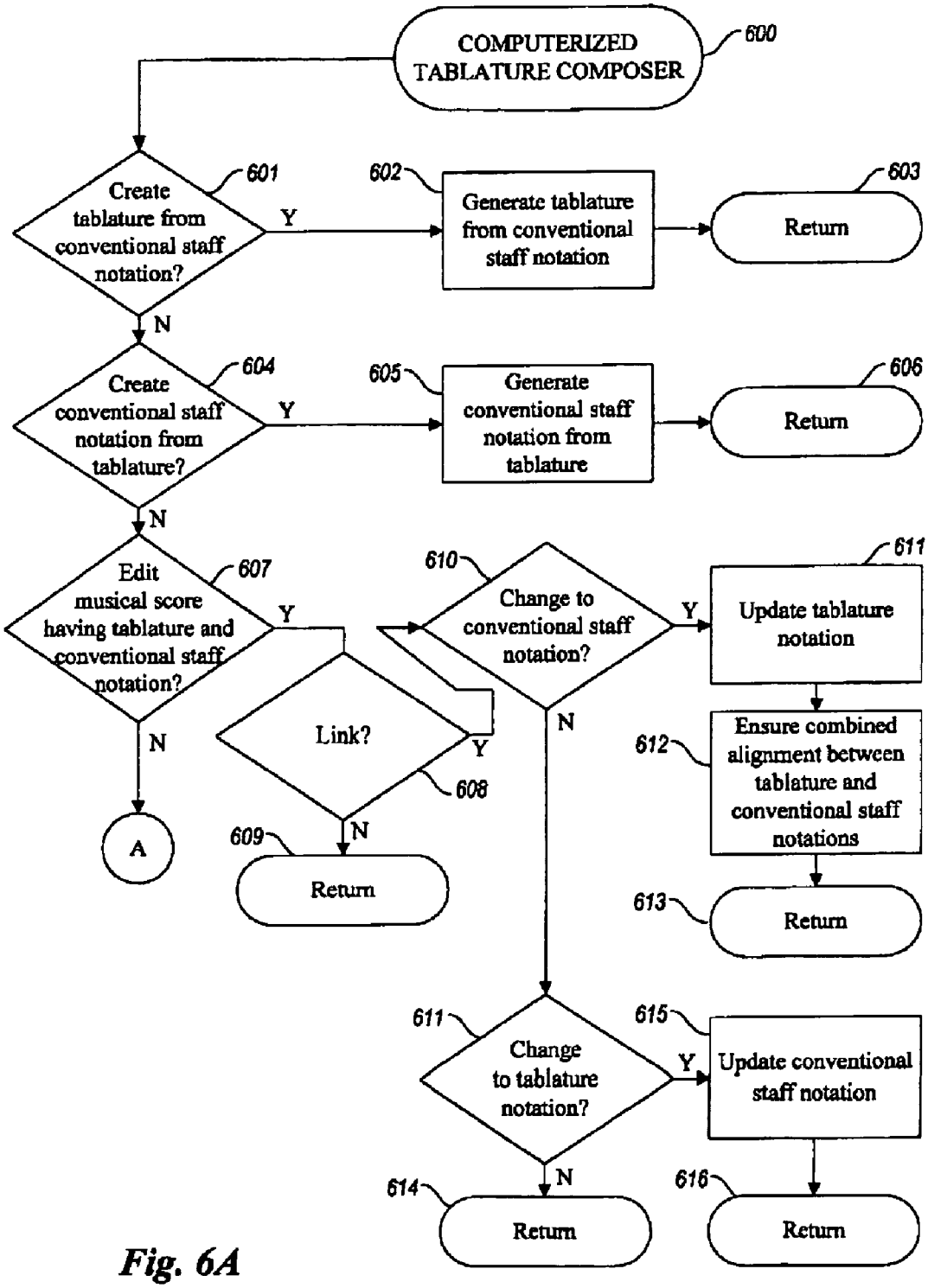
Fig. 6A Prior Art

FIG. 6 illustrates an exemplary embodiment of the Finger Finder invention where the complete fingering of a guitar composition is shown by the embodiment. This figure is very similar to the graphical output of the Finger Finder For Guitar program copyright. Feb. 4, 2002.

In FIG. 6, item 600 is the frame window of an application containing subwindows 602 and 606. Item 602 is a window containing a musical score for a guitar comprised of singe strokes and chords. Item 604 is the selected stroke of the composition whose complete fingering is shown in window 606. The graphics shown in window 606 is comprised of a row of guitar fret numbers 608, a column of string numbers 610, and encircled finger numbers 612 (1 for the index finger, 2 for the middle finger, 3 for the ring finger, and 4 for the little finger, all for the left hand); thus, the complete left hand fingering on a guitar is shown how to play stroke 604. It should be noted that for this invention, if the same stroke appears again in the same composition or another composition, its fingering may be completely different depending on the other strokes around the stroke.

What is claimed is:

1. A computing system for automatically determining hand and fingering positioning information for performing a musical composition on a musical instrument, comprising:

a. a memory, b. an input device for inputting the musical composition into the computing system, c. a processor for automatically (i) identifying all strokes and stroke groups in the input musical composition, wherein a stroke is a note or a chord, and wherein a stroke group comprises sequential strokes of the musical composition that can be played at one positional location on the musical instrument, (ii) selecting a stroke group to be used to determine the hand and fingering information for each stroke, wherein each selection is based on the shortest path of hand and fingering movement between sequential strokes, and (iii) using the selected stroke groups to determine the hand and fingering positioning information for playing the strokes in the musical composition on the musical instrument, and e. an output device for outputting the hand and fingering positioning information for performance of the musical composition on the musical instrument.

2. The computing system of claim 1, wherein the hand and fingering positioning information comprises an array of hand position information selected from the group consisting of which hand is being described, which finger is placed where on the musical instrument, and to which stroke in the musical composition the information refers.

3. The computing system of claim 2, wherein the hand and fingering positioning information is for a string instrument.

4. The computing system of claim 3, wherein the string instrument is a guitar and the hand and fingering positioning information indicates which finger is on which string and fret of the guitar.

5. The computing system of claim 2, wherein the hand and fingering positioning information is for a keyboard instrument.

6. The computing system of claim 5, wherein the keyboard instrument is a piano and the hand and fingering positioning information indicates which finger of which hand is on which key of the piano.

7. The computing system of claim 1, wherein the hand and fingering positioning information is such that hand movement is minimized on the musical instrument when performing the musical composition.

8. The computing system of claim 1, wherein the hand and fingering positioning information is such that the musical composition is easier to perform on the instrument for the skill level of a given performer.

9. The computing system of claim 1, wherein the hand and fingering positioning information is such that it provides for a preferred tonal stylization for a given performer or composer.

10. The computing system of claim 1, wherein the input device is selected from the group consisting of a data storage device containing digital musical data, a computer network from which digital musical data are obtained, a computer program, stored on a computer readable medium, where digital musical data are entered by a mouse, keyboard, or tablet, a MIDI device providing digital musical data, a digitizing scanner that scans paper containing the musical composition and a means of converting the digitized image into digital musical data, a microphone that captures musical sounds and a converter that converts the sounds into digital musical data.

11. The computing system of claim 1, wherein the output device is selected from the group consisting of a data storage device, a computer network, a printer, a computer monitor, and a device that uses the hand and fingering information for a musical performance.

12. The computing system of claim 1, wherein the computing system comprises a digitizing device for digitizing a musical composition that is input in a non-digitized form.

13. A method for automatically determining hand and fingering positional information for performing a musical composition on a musical instrument, comprising:

a. providing a computing system, b. inputting the musical composition into the computing system, c. using the computing system to automatically (i) identify all strokes and stroke groups in the input musical composition, wherein a stroke is a note or a chord, and wherein a stroke group comprises sequential strokes of the musical composition that can be played at one positional location on the musical instrument, (ii) select a stroke group to be used to determine the hand and fingering information for each stroke, wherein each selection is based on the shortest path of hand and fingering movement between sequential strokes, and (iii) use the selected stroke groups to determine the hand and fingering positioning information for playing the strokes in the musical composition on the musical instrument, and d. outputting the hand and fingering positioning information for performance of the musical composition on the musical instrument.

14. The method of claim 13, wherein the method outputs hand and fingering positional information for performing a musical composition on a keyboard instrument or a string instrument.

15. The method of claim 14, wherein the instrument is a piano or a guitar.

16. The method of claim 13, wherein the hand and fingering positioning information is comprised of which finger is placed where on the at least one musical instrument.

17. The method of claim 13, wherein the hand and fingering positioning information is such that hand movement is minimized on the musical instrument when performing the musical composition.

18. The method of claim 13, wherein the hand and fingering positioning information is such that the musical composition is easier to perform on the instrument for the skill level of a given performer.

19. The method of claim 13, wherein the hand and fingering positioning information is such that it provides for a preferred tonal stylization for a given performer or composer.

20. The method of claim 13 wherein the input musical composition is comprised of a musical score or tablature information.

21. The method of claim 13, wherein the input means is selected from the group consisting of a data storage device containing digital musical data, a computer network from which digital musical data are obtained, a computer program, stored on a computer readable medium, where digital musical data are entered by a mouse, keyboard, or tablet, a MIDI device providing digital musical data, a digitizing scanner that scans paper containing the musical composition and a means of converting the digitized image into digital musical data, a microphone that captures musical sounds and a converter that converts the sounds into digital musical data.

22. The method of claim 13, wherein the output means is selected from the group consisting of a data storage device, a computer network, a printer, a computer monitor, and a device that uses the hand and fingering information for a musical performance.

23. A computing system for automatically determining hand and fingering positioning information for performing a musical composition on a musical instrument, comprising:

a. a memory, b. an input device for inputting the musical composition into the computing system, c. a processor for automatically (i) identifying all strokes and stroke groups in the input musical composition, wherein a stroke is a note or a chord, and wherein a stroke group comprises sequential strokes of the musical composition that can be played at one positional location on the musical instrument, (ii) selecting a stroke group to be used to determine the hand and fingering information for each stroke, wherein each selection is consistent with a user preference selected from the group consisting of easier fingering, minimized hand movement, ease of performance, and tonal quality, and (iii) using the selected stroke groups to determine the hand and fingering positioning information for playing the strokes in the musical composition on the musical instrument in the user preferred manner, and e. an output device for outputting the hand and fingering positioning information for performance of the musical composition on the musical instrument according to the user preference.

* * * * *

UNITED STATES PATENT AND TRADEMARK OFFICE

CERTIFICATE OF CORRECTION

PATENT NO. : 7,238,876 B1
APPLICATION NO. : 10/766633
DATED : July 3, 2007
INVENTOR(S) : Richard William Worrall and Robert William Sharp It is certified that error appears in the above-identified patent and that said Letters Patent is hereby corrected as shown below:

Column 8, line 32 “and” should read --any--
Column 10, line 11 “singe” should read --single--
Claim 1, line 46 “e.” should read --d.--
Claim 23, line 59 “e.” should read --d.--

Signed and Sealed this

Second Day of October, 2007

JON W. DUDAS
*Director of the United States Patent and Trademark Office*